United States Patent [19]

Scherbing

[11] 4,111,020

[45] Sep. 5, 1978

[54] PICK-RESISTANT AXIAL SPLIT-PIN TUMBLER-TYPE LOCK MECHANISM

[75] Inventor: Frank J. Scherbing, Chicago, Ill.

[73] Assignee: Chicago Lock Co., Chicago, Ill.

[21] Appl. No.: 824,443

[22] Filed: Aug. 15, 1977

[51] Int. Cl.[2] ..... E05B 27/08

[52] U.S. Cl. ..... 70/363; 70/378; 70/419

[58] Field of Search ..... 70/363, 376, 378, 416, 70/419, 421

[56] References Cited

U.S. PATENT DOCUMENTS

| | | | |
|---|---|---|---|
| 651,130 | 6/1900 | Carter | 70/363 |
| 1,619,252 | 3/1927 | George | 70/363 |
| 1,998,900 | 4/1935 | Lombardo | 70/363 |
| 3,681,955 | 8/1972 | Sturgeon | 70/363 |
| 4,041,739 | 8/1977 | Mercurio | 70/419 |

*Primary Examiner*—Robert L. Wolfe
*Attorney, Agent, or Firm*—Norman H. Gerlach

[57] ABSTRACT

An axial split-pin tumbler-type lock mechanism includes a rotatable operating part and a stationary part, which adjoin at an interfacial plane. Tumblers each including a driver element and a follower element are mounted in bores in the parts, which bores meet in alignment at the interfacial plane, and the tumblers are movable back and forth in the bores. When the joints between the tumbler elements coincide with the interfacial plane upon insertion of a key, the operating part may be rotated by means of the key, to accomplish a desired function. The lock mechanism is provided with structure making it resistant to picking, including ledge means on the operating part adjacent to and intermediate the ends of a bore in the stationary part, and rib means on a follower element carried in the latter bore and adapted to overlappingly engage the ledge means when picking torque is applied to the operating part and while the joint of the tumbler which includes the latter follower element is displaced from the interfacial plane, for preventing longitudinal movement of the follower element in the direction of the interfacial plane.

18 Claims, 20 Drawing Figures

PICK-RESISTANT AXIAL SPLIT-PIN TUMBLER-TYPE LOCK MECHANISM

BACKGROUND OF THE INVENTION

This invention relates to axial split-pin tumbler-type lock mechanisms having structure designed to render them resistant to picking.

In general, the axial split-pin tumbler-type lock mechanisms include a rotatable operating part and a stationary part, which adjoin at an interfacial plane. Tumblers each including a driver element and a follower element are mounted in bores in the parts, which bores meet in alignment at the interfacial plane, and the tumblers are movable back and forth in the bores. When the joints between the tumbler elements coincide with the interfacial plane upon insertion of the proper key, the operating part may be rotated by means of the key, to accomplish a desired function. Illustrative of the lock mechanisms to which the present invention is directed are Kerr U.S. Pat. No. 3,541,819, Kerr U.S. Pat. No. 3,813,906, and Steinbach U.S. Pat. No. 3,916,657.

As disclosed in U.S. Pat. No. 3,541,819, the lock mechanisms of the foregoing type have in the past been picked, employing what may be referred to as a "gang pick", of the type disclosed in the patent. In use, the pick is applied to the lock mechanism, a rotational torque or bias is applied to the operating part thereby, to displace the operating part to a slight extent relative to the stationary part, and a jiggling motion is utilized to catch tumbler elements on the margins of tumbler bores which project over adjacent bores, until elements of all of the tumblers have been caught at the interfacial plane in such manner and the operating part is free to rotate, the mechanism then being in unlocked condition. Numerous improvements have been devised to increase the pick resistance of such lock mechanisms, as illustrated by the foregoing patents, and they have met with varying degrees of success.

SUMMARY OF THE INVENTION

The present invention provides an axial split-pin tumbler-type lock mechanism having new and improved structure serving to render the mechanism pick-resistant, the structure being especially adapted to resist picking with the common gang-type pick, such as illustrated in the above-identified U.S. Pat. No. 3,541,819.

In its broader aspects, the invention provides an improvement in an axial split-pin tumbler-type lock mechanism including a lock cylinder, a barrel assembly secured within the cylinder and having a longitudinal axis extending between front and rear ends thereof, such barrel assembly including a forwardly disposed operating part rotatable about the axis and a rearwardly disposed stationary part adjoining the operating part at a transverse interfacial plane, means forming longitudinal bores in the operating and stationary parts, respectively, the bores in respective parts being movable into and out of alignment upon rotation of the operating part, tumblers each having a forwardly disposed driver element carried in one of the operating part bores and a separate rearwardly disposed follower element carried in one of the stationary part bores and the elements adjoining each other when in a pair of aligned bores, the tumblers each being respectively movable in the axial direction in a pair of aligned bores between positions wherein the joint between the elements thereof is disposed on opposite sides of the interfacial plane, the operating part being freed for rotation when the joints coincide with the interfacial plane, and spring means yieldingly urging the tumblers in aligned bores forwardly to positions wherein the interfacial plane is bridged by the follower elements to secure the operating and stationary parts against relative rotation, the driver elements having front ends engageable with a key which when moved rearwardly moves the tumblers in aligned bores into positions wherein the joints coincide with the interfacial plane, such improvement comprising: ledge means on the operating part and adjacent to and intermediate the ends of a bore in said stationary parts, and rib means on a follower element carried in the latter bore and adapted to overlappingly engage the ledge means when picking torque is applied to the operating part and while the joint of the tumbler which includes the follower element is displaced from the interfacial plane, for preventing longitudinal movement of the last-named follower element in the direction of the interfacial plane.

When a lock mechanism is provided with the improved structure, the application of rotational torque by the picking tool and resulting interengagement of the rib means and the ledge means precludes movement of the tumbler joint into coincidence with the interfacial plane, as is necessary to reach an unlocked condition. Thus, the application of torque, which is required for picking the remaining tumblers, prevents picking of the one or more tumblers constructed according to the invention, thereby defeating the picking attempt.

Maximum effectiveness is achieved in the invention by providing a plurality of ledges spaced apart along the operating part, and a plurality of ribs spaced apart along the follower element, whereby at least one rib is adapted to overlappingly engage a ledge at each of a plurality of different longitudinal positions of the follower element relative to the operating part, for preventing movement of the follower element in the direction of the interfacial plane. Thus, the follower element may catch on a ledge at any of a plurality of points, when rotational torque is applied during a picking attempt, to decrease the likelihood of success. Preferably, a plurality of ribs is arranged to engage a corresponding plurality of ledges at each of the plurality of positions of the follower element relative to the operating part, further reducing the likelihood of success.

In another preferred embodiment, and in addition to the overlapping interengagement of the rib means and the ledge means, the rib means are adapted for abuttingly interengaging the ledge means in an alternate longitudinal position of the follower element when picking torque is applied to the operating part, for limiting rotational displacement of the operating part relative to the sleeve part. With this structure, the displacement necessary for picking the remaining tumblers cannot be achieved when the rib means is in the alternate position, thereby providing an additional safeguard against picking.

BRIEF DESCRIPTION OF THE DRAWINGS

The attached drawings illustrate a preferred embodiment of the lock mechanism of the invention, without limitation thereto. In the drawings, like elements are identified by like reference symbols in each of the views, and.

DESCRIPTION OF THE PREFERRED EMBODIMENT

Figure 2:
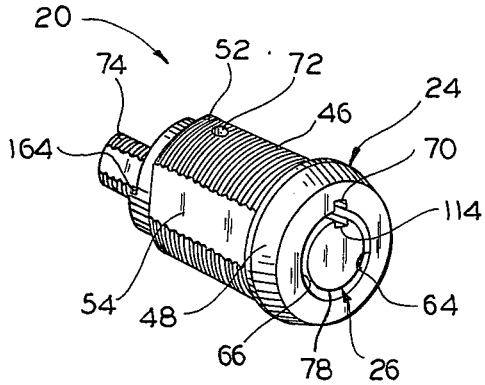
FIG. 2 is a front perspective view of a lock mechanism or lock, in accordance with the invention.

Referring to the drawings, particularly to FIGS. 1–4, an axial split-pin tumbler-type lock mechanism or lock 20 is employed with a tubular key 22. The locking components of the lock mechanism and the key are, in general, similar to the corresponding structures of prior lock mechanisms of the same type, with the exceptions described hereinafter. The particular illustrative lock mechanism 20 is designed for use with a locking plate or cam structure, not shown, such as illustrated in U.S. Pat. No. 3,541,819, but may be modified for other uses, such as with switch components, for example, in the manner illustrated in U.S. Pat. No. 3,813,906.

Figure 4:
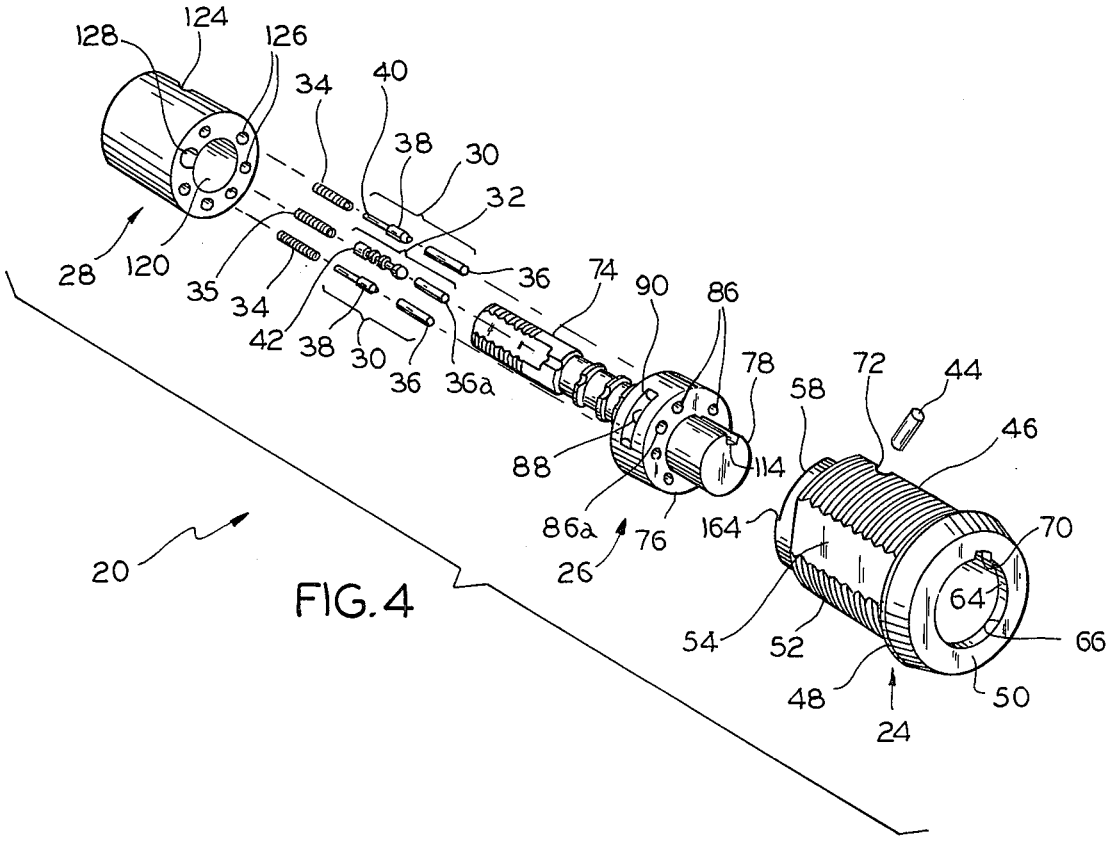
FIG. 4 is an exploded perspective view of the lock mechanism.
Figure 5:
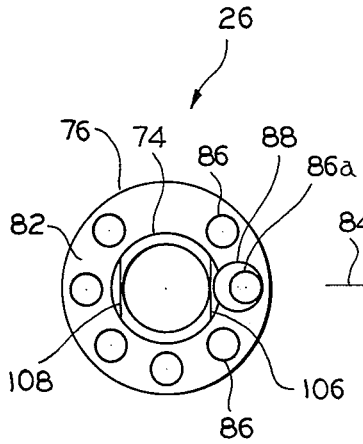
FIGS. 5–7 are, respectively, enlarged rear end elevational, side elevational, and front end elevational views of an operating part in the lock mechanism.

The lock mechanism 20 includes, as its principal parts, a lock cylinder 24, a rotatable operating part 26, and a stationary tubular sleeve part 28, the operating part and the sleeve part together constituting a barrel assembly. The lock mechanism 20 also includes a plurality of conventional tumblers 30, which are six in number in the illustrative embodiment and two of which are illustrated in FIG. 4, a pick-resistant tumbler 32, a coil compression tumbler spring 34 for each conventional tumbler 30, and a coil compression tumbler spring 35 for the pick-resistant tumbler 32. Each of the tumblers 30 and 32 includes a driver element or pin 36, all of which are similar, except for varying lengths, the driver element for the pick-resistant tumbler 32 being identified more specifically as 36*a*. Each of the conventional tumblers 30 includes a follower or locking element or pin 38 having a reduced diameter stem 40. The pick-resistant tumbler 32 includes a pick-resistant follower or locking element 42 of special design in accordance with the invention, as described hereinafter. The components of the lock mechanism 20 are secured together by means of a mounting pin 44.

The lock cylinder 24 includes a generally cylindrical body 46 and a frusto-conical head 48 of greater diameter and integral with the body at the front end 50 of the lock cylinder. The body is provided with a raised threaded section 52, and a pair of diametrically opposed longitudinally extending flats 54. The foregoing structure serves for mounting the lock mechanism 20 in a door or wall panel or the like and in a conventional manner. Thus, for example, the body 46 may be inserted in a similarly shaped opening in such a panel, with the head 48 adjacent to one side of the panel. The lock cylinder 24 is secured in place by a nut, not shown, which engages the threaded section 52 and is tightened against the opposite side of the panel.

Figure 12:
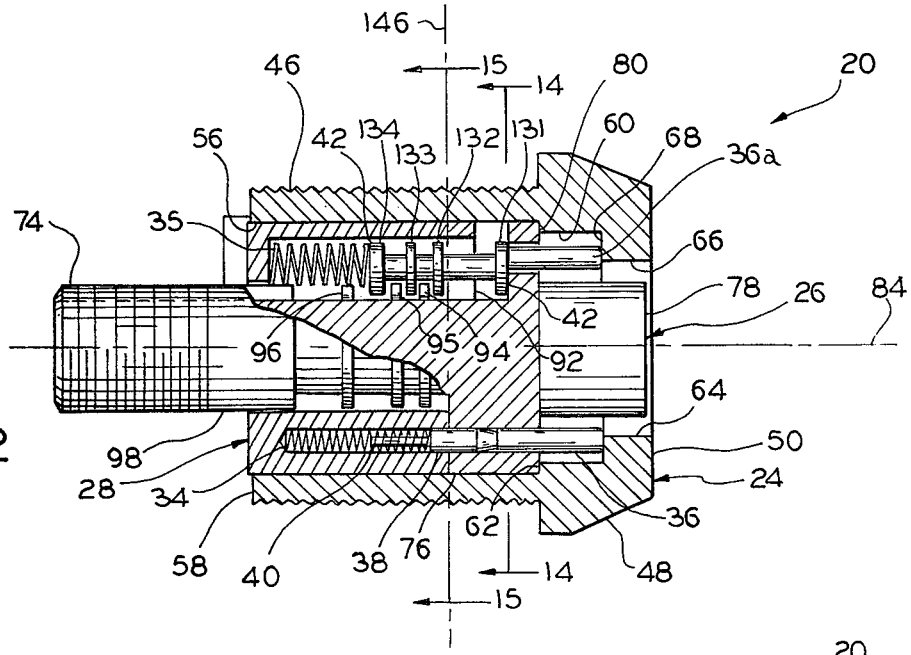
FIGS. 12 and 13 are further enlarged longitudinal sectional and partly elevational views of the lock mechanism, illustrating, respectively, locked and unlocked conditions of the mechanism.

Referring to FIG. 12, the cylinder body 46 has a longitudinal cylindrical bore 56 extending forwardly from its rear end 58. A second longitudinal cylindrical bore 60 of reduced diameter is provided in the head 48 adjacent to the front end 50. A rearwardly facing annular retention shoulder 62 extends between the bores 56 and 60 where they terminate adjacent to each other. An annular closure flange 64 extends radially inwardly from the head 48 at the front end 50 of the lock cylinder, and it defines a circular key opening 66. The flange 64 forms a rearwardly facing annular shoulder 68 on the wall of the front bore 60. A key guide notch 70 (FIGS. 2 and 4) extends radially outwardly from the inner edge of the closure flange 64. A radial mounting hole 72 (FIG. 4) is provided in the body 46, and it serves to receive the mounting pin 44.

Referring to FIGS. 4–7, the operating part 26 in the illustrative embodiment is an integral unit of a shaft 74, a cylindrical head 76 of greater diameter, and a cylindrical key guide post 78 having a diameter intermediate the diameters of the shaft and the head. Alternatively, any of the shaft 74, the head 76, and the post 78 may be constructed separately or integrally with one of the remaining components, as most desirable for manufacture and intended use.

The operating part head 76 has parallel circular front and rear faces 80 and 82, which lie in planes perpendicular to the longitudinal axis 84 of the operating part. An annular series of longitudinal cylindrical tumbler bores 86 extends through the head 76, there being seven such bores having the same diameter in the illustrative embodiment. The bores 86 are equidistantly spaced radially outwardly from the axis 84 and from the guide post 78, at angles of 45° to each other, except for a 90° spacing between two of the bores. A counterbore 88 extends inwardly from the rear face 82 of the head 76, eccentrically with respect to one of the tumbler bores 86*a*, the latter having a perimeter which is inscribed within and tangent to the perimeter of the counterbore, as viewed in FIGS. 5 and 7. A transverse arcuate groove 90 is provided in the side of the head 76 and intermediate the front and rear faces 80 and 82. The margin of the groove 90 corresponds to the arc of a circle which intersects the circle defining the head 76, as viewed in FIG. 7. The perimeter of the bore 88*a* and a major portion of the perimeter of the counterbore 88 lie within the intersection of such circles, such bores thereby communicating with the groove 90. The groove 90 also intersects the bores 86 on opposite sides of the bore 86*a*. The groove 90 is bounded on its rear side by a transverse arcuate ledge 92, which is disposed intermediate the front and rear faces 80 and 82 and adjacent to the counterbore 88.

The shaft 74 is constructed of a cylindrical body turned down to provide three annular ledges 94–96, which are spaced apart from each other, from the rear face 82 of the head 76, and from a mounting portion 98 at the rear end of the shaft. A cylindrical body portion 100 remains on the shaft, between the mounting portion 98 and the head 76. The ledges 94–96 and the body portion 100 define a series of annular grooves 101–104 on the surface of the shaft 74.

The mounting portion 98 of the shaft 74 is provided with a pair of diametrically opposed longitudinal flats 106 and 108, and a threaded terminal section 110. The shaft 74 is cylindrically splined to provide a movement path 112 longitudinally along the surface thereof, which intersects the ledges 94–96 and is defined by the margins of a series of arcuate cutouts 94*a*–96*a* therein. The cutouts 94*a*–96*a* register or are aligned with the inner segment of the counterbore 88. A longitudinal drive groove 114 is provided in the guide post 78, which otherwise has a smooth cylindrical outer surface.

Figure 8:
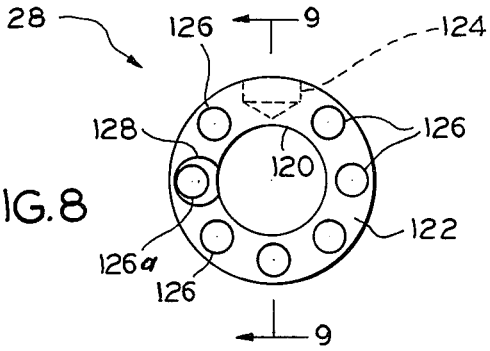
FIG. 8 is an enlarged front end elevational view of a stationary sleeve part in the lock mechanism.
Figure 9:
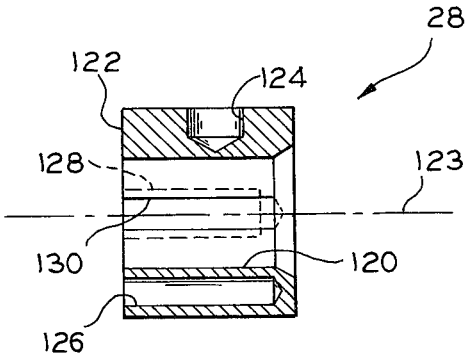
FIG. 9 is a longitudinal sectional view of the sleeve part, taken substantially on line 9–9 of FIG. 8.

Referring to FIGS. 8 and 9, the sleeve part 28 is of cylindrical configuration, having an outside diameter the same as the diameter of the operating part head 76, and both diameters being slightly smaller than the diameter of the rear cylinder bore 56. The sleeve part 28 has a substantially cylindrical inner wall surface 120, which has a diameter slightly greater than the outer diameter of the shaft mounting portion 98 and the annular ledges 94–96, for journaling such ledges in the sleeve part. The sleeve part 28 has a front face 122 which lies in a plane perpendicular to the longitudinal axis 123 of the part. A radial mounting bore 124 is provided in the sleeve part 28 intermediate its ends.

An annular series of longitudinal cylindrical tumbler blind bores 126 is provided in the sleeve part 28, extending rearwardly from the front face 122 thereof. A counterbore 128 extends rearwardly from the front face 122 and encompasses one tumbler bore 126*a*, eccentrically with respect thereto. The perimeter of the one tumbler bore 126*a* is inscribed within and tangent to the perimeter of the counterbore 128, as viewed in FIG. 8. The counterbore 128 intersects the inner wall surface 120 on the sleeve part 28, to place the counterbore in open communication with the interior of the sleeve part along a rectangular opening 130 in the wall surface.

The tumbler bores 126 in the sleeve part 28 have the same diameters and angular spacing as the tumbler bores 86 in the operating part 26. The radial distance of the sleeve part bores 126 from the longitudinal axis 123 of the sleeve part is the same as the radial distance of the operating part bores 86 from the longitudinal axis 84 of the operating part. The counterbore 128 in the sleeve part has the same diameter as the counterbore 88 in the head 76, and it is oriented with respect to the bore 126*a* encompassed thereby and the axis 123 in the same manner as the counterbore 88 in the head 76 is oriented with respect to the bore 86*a* and the axis 84.

Referring to FIG. 4, the driver elements 36, including the element 36*a*, are of conventional construction, and, in general, they function in a conventional manner. The driver elements 36 are substantially cylindrical pins each having a diameter slightly smaller than the diameters of the tumbler bores 86 and 126. The follower elements 38 in the conventional tumblers 30 also are of conventional construction and function in a conventional manner. Their outer diameters are the same as the diameters of the driver elements 36. The reduced diameter stems 40 are received in the tumbler springs 34.

Figure 10:
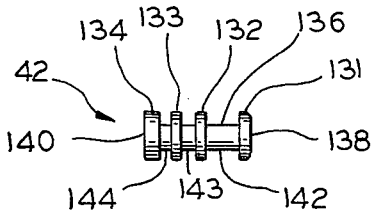
FIGS. 10 and 11 are, respectively, enlarged side elevational and front end elevational views of a pick-resistant follower element of a tumbler in the lock mechanism.
Figure 11:
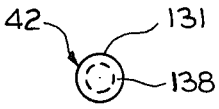

Referring to FIGS. 4, 10 and 11, the pick-resistant follower element 42 in the illustrative embodiment is in the form of a cylindrical pin turned down to provide a longitudinal series of four spaced apart annular ribs 131–134 on a cylindrical body 136. One of the ribs 131 is integral with the head 138 of the element, and another element 134 is integral with the foot 140 of the element, with the remaining elements 132 and 133 spaced apart therebetween. The ribs 131–134 and the body 136 provide a corresponding longitudinal series of three spaced apart annular grooves 142–144. The outside diameter of the ribs 131–134 in the illustrative form of the invention is greater than the diameter of the conventional driver elements 36 and follower elements 38. The circles defining the ribs 131–134 have substantially the same radius as the radii of the counterbore 88 in the operating part head 76, the cutouts 94*a*–96*a* in the annular ledges 94–96, and the counterbore 128 in the sleeve part 28, with clearance enabling the follower element 42 to move in the movement path 112 longitudinally with respect thereto, as subsequently described.

Figure 6:
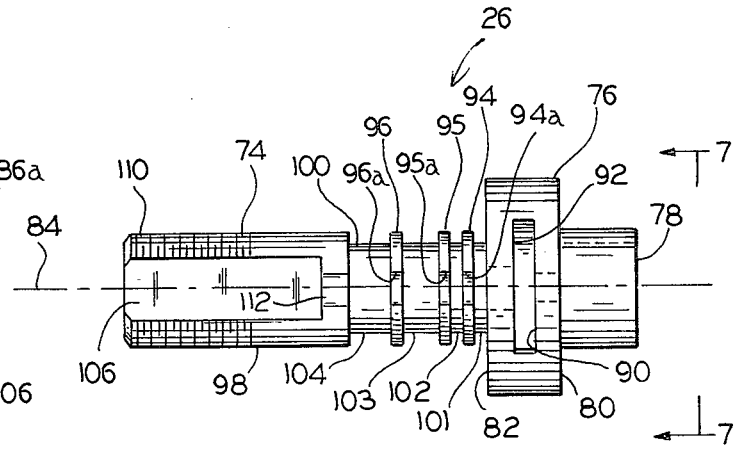
Figure 7:
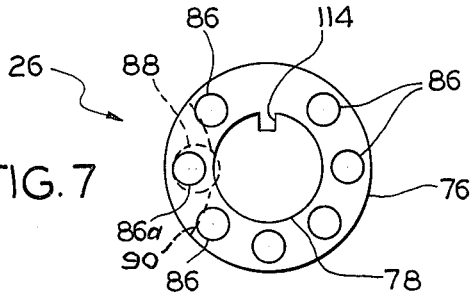
Figure 17:
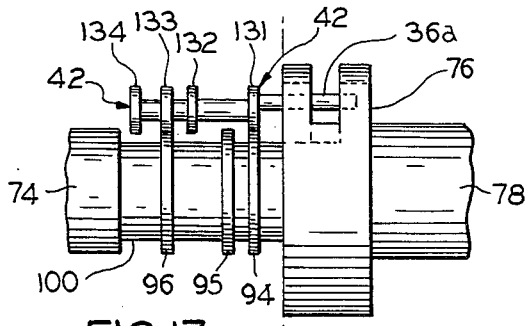
Figure 18:
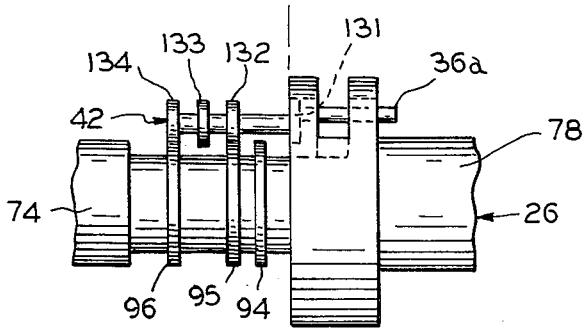

Referring to FIGS. 6 and 8, the longitudinal spacing between the frontmost or first annular ledge 94 and the rear face 82 of the head 76, and the spacing between the first and second annular ledges 94 and 95 are slightly greater than the width or thickness of each of the first three ribs 131–133 on the pick-resistant follower element 42, for receiving one of such ribs therebetween, in one of the grooves 101 and 102 adjacent to the ledges. The spacing between the second and third annular ledges 94 and 96, and the spacing between the third annular ledge 96 and the mounting portion 98 are such as to receive two adjacent ribs 132 and 133, or 133 and 134 therebetween, in one of the grooves 103 and 104. The foregoing reception of the ribs 131–134 in the grooves 101–104, whereby the ribs interfit or mesh with the annular ledges 94–96, is illustrated in FIGS. 12, 13, 16 and 19. The spacings and widths of the annular ledges 94–96 and of the ribs 131–134 also are such as to enable the ribs to be seated in the cutouts 94*a*–96*a*, two at a time, as illustrated in FIGS. 17, 18 and 20.

Referring to FIGS. 4 and 12, the operating part shaft 74 is inserted through the sleeve part 28 in assembling the lock mechanism 20. The tumbler springs 34 for the conventional tumblers 30 are seated in the tumbler bores 126 in the sleeve part. The tumbler spring 35 for the pick-resistant follower element 42 is seated in the counterbore 128 in the sleeve part. The conventional follower elements 38 are seated on the tumbler springs 34, with their stems 40 received therein. The pick-resistant follower element 42 is seated on its spring 35. The pick-resistant follower element 42, having substantially the diameter of the counterbore 128 in the sleeve part 28, projects laterally or radially outwardly through the opening 130 in the inner wall surface 120 into the interior of the sleeve part, where it is received in the movement path 112 on the operating part 26. The driver elements 36 are seated on the follower elements, the driver element 36*a* being seated on the pick-resistant follower element 42. The assembly is inserted into the cylinder bore 52 from the rear end 58 of the cylinder 24, with the guide post 78 extending into the key opening 66 and approximately to the front end 50 of the cylinder, as illustrated in FIG. 12. The inserted members are secured within the cylinder 24 by insertion of the mounting pin 44 through the mounting hole 72 in the cylinder and into the registering mounting bore 124 in the sleeve part 28, with a drive fit therein. The rear face 82 of the operating part head 76 adjoins the front face 122 of the sleeve part 28 at a transverse interfacial plane 146.

In general, the follower elements 38 and 42 are carried in the sleeve part bores 126 and 128, and the driver elements 36 are carried in the operating part bores 86 and 88. However, as illustrated in FIG. 12, under the pressure of the tumbler springs 34 and 35, the follower elements 38 and 42 extend into the operating part head 76, bridging the interfacial plane 146 when the lock mechanism 20 is in its locked condition. At this time, the front ends of the driver elements 36 abut on the shoulder 68, with portions of the driver elements extending radially inwardly beyond the closure flange 64 and accessible through the key opening 66 (as seen also in FIG. 3). The tumblers 30 and 32 are reciprocally movable in the axial direction in respective pairs of aligned tumbler bores 86 and 126, and 88 and 128, between positions wherein the joints between the tumbler elements are disposed respectively on opposite sides of the interfacial plane 146, such joints comprising the interfaces between the front ends of the follower elements 38 and 42 and the rear ends of the driver elements 36.

With the parts assembled in the lock mechanism 20, the longitudinal axis 84 of the operating part is coincident with the longitudinal axis 123 of the sleeve part, and with the longitudinal axis of the lock cylinder 24, as represented by the axis 84 in FIG. 12. The sleeve part 28 is stationary in the lock mechanism, and the operating part 26 is rotatable therein when the joints between the tumbler elements coincide with the interfacial plane 146. Rotation of the operating part 26 serves to perform a desired function, by means of a connection made to the shaft 74. As noted above, the illustrative structure is designed for mounting a locking plate on the shaft. Alternatively, other functions may be performed in a conventional manner.

Figure 1:
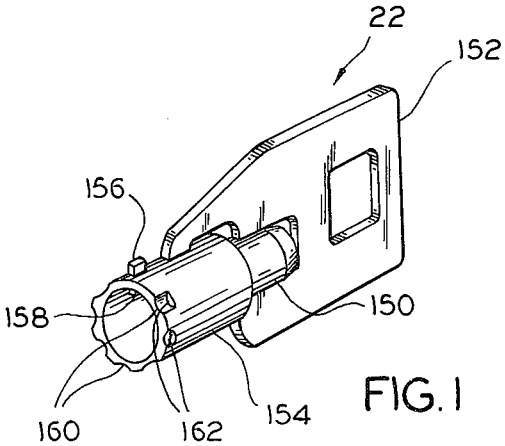
FIG. 1 is a perspective view of a key which cooperates with the lock mechanism of FIG. 2.
Figure 3:
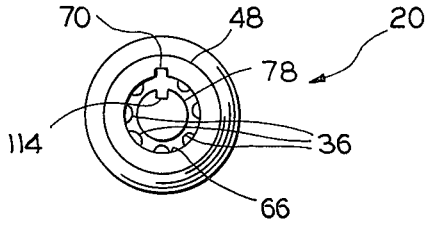
FIG. 3 is a front end elevational view of the lock mechanism.

Referring to FIG. 1, the key 22 is a conventional structure, which includes a body 150 connected to a wing-type torque-applying or manipulating handle 152. The body includes a cylindrical tubular shank 154 having an inside diameter slightly greater than the diameter of the guide post 78. Adjacent to the outer end of the shank 154, a longitudinally extending guide lug 156 extends radially outwardly from the shrank, and a longitudinally extending drive lug 158 extends radially inwardly from the shank. Transversely arcuate grooves 160 are formed in the outer surface of the shank 154, and they extend longitudinally from the outer end thereof and terminate in bittings or shoulders 162. The grooves 160 and the corresponding bittings 162 each are seven in number and spaced apart at angles of 45°, except for two of each, which are on opposite sides of the lugs and spaced apart 90°.

Figure 13:
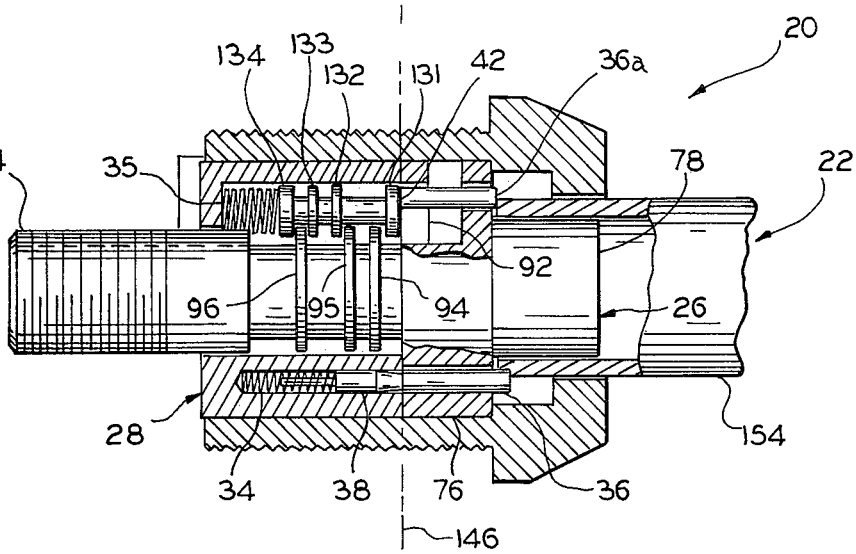

Referring to FIGS. 1-3 and 13, the key guide notch 70 and the drive groove 114 are radially aligned when the lock mechanism 20 is in its initial, locked condition. The key 22 is inserted in the lock mechanism for unlocking purposes by inserting the shank 154 in the key opening 66 and around the guide post 78. The guide lug 156 on the key is inserted in the guide notch 70 in the closure flange 64, and the drive lug 158 is inserted in the drive groove 114 in the post. The driver elements 36 of the tumblers 30 and 32 are received in part in the key grooves 160, and the front ends of the driver elements abuttingly engage the key bittings 162. Rearward movement of the key 22 moves the tumblers in aligned tumbler bores 86 and 126, and 88 and 128 rearwardly, until the shank 154 of the key bottoms on the front face 80 of the operating part head 76, as illustrated in FIG. 13. The follower element 42 moves longitudinally in the movement path 112, while the ribs 131-134 thereon pass the ledges 92 and 94-96 on the operating part 26 without interference. With the key fully inserted, the joints between the driver elements 36 and the follower elements 38 and 42 coincide with the interfacial plane 146, and the guide lug 156 on the key is disposed rearwardly of the closure flange 64, so that the key may be turned to rotate the operating part 26 and thereby operate the lock mechanism 20. In the illustrative embodiment, the operating part 26 is rotated in the clockwise direction, as viewed from the front end 50, and the extent of rotation is controlled by engagement of a rearwardly projecting shouldered portion 164 of the cylinder body 46 (see FIGS. 2 and 4) with a suitable stop cam, not shown, which is mounted on the shaft 74.

As noted above, the common picking tool described in U.S. Pat. No. 3,541,819 depends for its success upon the application of a rotational torque or bias applied to an operating part such as the part 26, to rotate it slightly relative to a sleeve part such as the part 28, while the tumblers are manipulated utilizing a fore-and-aft jiggling motion, during which the tumblers gradually move into positions wherein their joints coincide with an interfacial plane such as the plane 146. The lock mechanism 20, however, is constructed to prevent this technique from being successful. Thus, the operating part 26 and the pick-resistant follower element 42 of the tumbler 32 are constructed and arranged so that when the ribs 131-134 are in staggered relation to the ledges 92 and 94-96, and the follower element 42 is not fully situated in the movement path 112, the ribs are received in the grooves 90 and 101-104, and the ribs overlap the ledges. This condition will be brought about in several longitudinal positions of the pick-resistant tumbler 32, described hereinafter, when rotational torque is applied by a picking tool. The overlapping takes place when the pick-resistant follower element 42 is held by the stationary sleeve part 28 and prevented from moving about the axis 84, while the operating part 26 is displaced about such axis.

Figure 14:
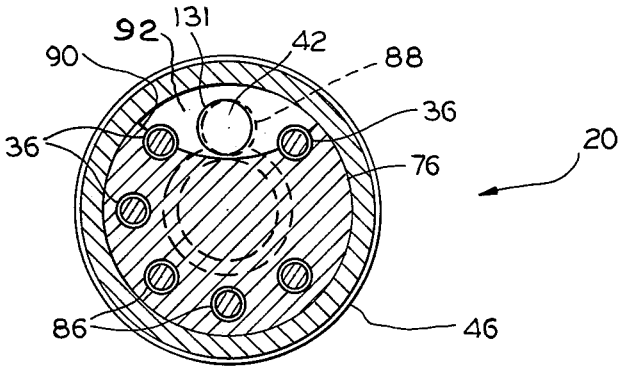
FIGS. 14 and 15 are cross sectional views of the lock mechanism, taken substantially on lines 14—14 and 15—15, respectively, of FIG. 12.
Figure 15:
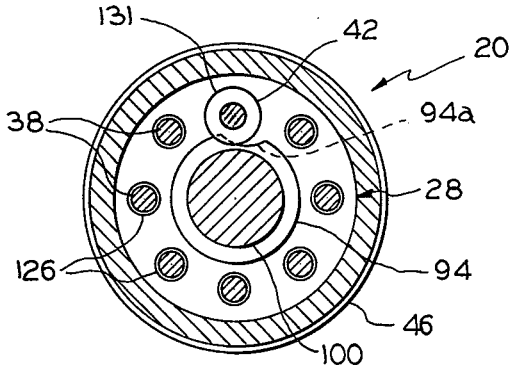
Figure 16:
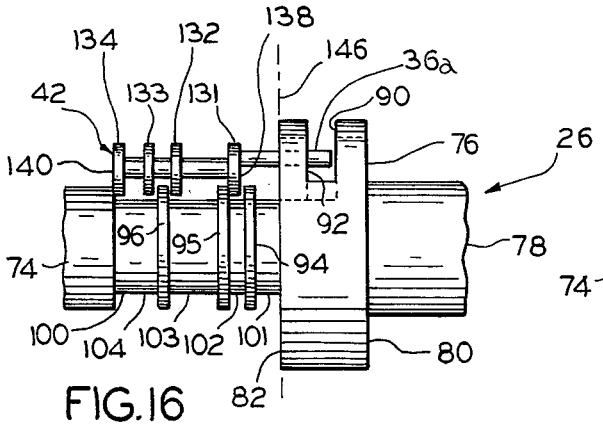
FIGS. 16 through 20 are fragmentary views showing the tumbler which includes the pick-resistant follower element, and the operating part in the lock mechanism, illustrating successive positions of the tumbler relative to the operating part.

The relative rotational displacement which might be effected during a picking attempt is illustrated in FIGS. 14 and 15. FIG. 14 illustrates in broken line the position of the margin of the counterbore 88 relative to the periphery of the first rib 131 when the operating part 26 is rotated in the clockwise direction relative to the pick-resistant follower element 42. FIG. 15 similarly illustrates the position of the margin of the cutout 94*a* relative to the periphery of the second rib 132 upon such rotation. In the first instance, the first rib 131 overlaps the ledge 92 at the margin of the counterbore 88. In the second instance, the second rib 132 overlaps the first annular ledge 94. Such overlapping will prevent the pick-resistant follower element 42 from moving longitudinally, so that the pick-resistant tumbler 32 cannot be picked.

The operating part 26 and the pick-resistant follower element 42 also cooperate in alternate longitudinal positions of the tumbler 32 to defeat a picking attempt using the above-described technique. Thus, when the position of the follower element 42 is such that certain of the ribs 131-134 are seated in a corresponding number of the ledges 94-96, in their cutouts 94*a*-96*b*, the ribs will abuttingly engage the ledges when rotational torque is applied to the operating part 26 by a picking tool. Since the follower element 42 is held by the stationary sleeve part 28, the engagement of the ribs with the ledges will prevent the operating part 26 from being displaced to the extent necessary for picking the remaining tumblers 30.

FIGS. 16–20 illustrate the cooperation of the pick-resistant tumbler 32 and the operating part 26 in preventing picking in different longitudinal positions of the tumbler. When the above-described picking tool is manipulated in an attempt to pick the lock mechanism 20 using one technique, and commencing with the mechanism in its locked condition illustrated in FIG. 12, the tool is operated to push all of the tumblers 30 and 32 rearwardly or inwardly, with the tumbler joints disposed rearwardly of the interfacial plane 146 and the driver elements 36 bridging the interfacial plane. A clockwise rotational force is applied to the tool, which rotationally displaces the operating part 26 slightly in the clockwise direction, owing to the tolerances in the mechanism. The tool is manipulated with back-to-front movement. At this time, the pick-resistant follower element 42 is in the position illustrated in FIG. 16, with the first rib 131 interfitting with and overlapping the first and second annular ledges 94 and 95, and the second and third ribs 132 and 133 in similar interfitting relationship on opposite sides of the third annular ledge 96. The relationships are similar to the broken line showing in FIG. 15. Accordingly, the first and third ribs 131 and 133 will engage the first and third annular ledges 94 and 96, respectively, to prevent forward movement of the follower element 42, in the direction of the interfacial plane 146. Therefore, the operator of the picking tool will be unable to bring the head 138 of the follower element 42 up to the interfacial plane 146, and the driver element 36*a* will continue to bridge the interfacial plane, so that the operating part 26 cannot be rotated for unlocking purposes and the picking attempt will be thwarted.

In the event that the pick-resistant follower element 42 arrives at a slightly more forward position during operation of the picking tool, as illustrated in FIG. 17, the first and third ribs 131 and 133 will lie in the cutouts 94*a* and 96*a* of the first and third annular ledges 94 and 96, respectively. In this position of the follower element 42, the ribs 131 and 133 are situated for abuttingly engaging the ledges 94 and 96, with their side edges in contact, to prevent rotation of the operating part 26 relative to the sleeve part 28 to the extent necessary for picking the tumblers 30 when picking torque is applied to the operating part.

Employing another technique, the picking tool may be manipulated with front-to-back movement, in which case, the pick-resistant follower element 42 may be or arrive at one of the longitudinal positions illustrated in FIGS. 12 and 18–20.

Figure 19:
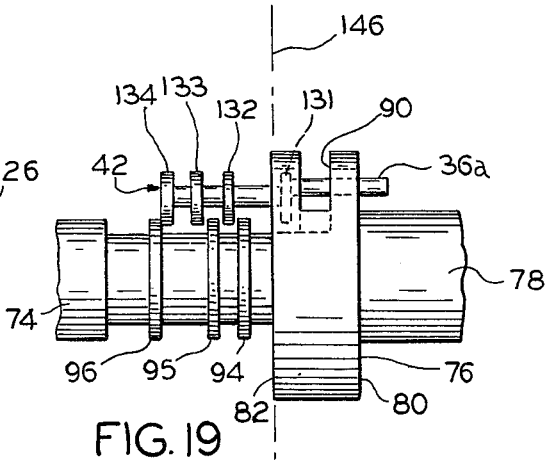
Figure 20:
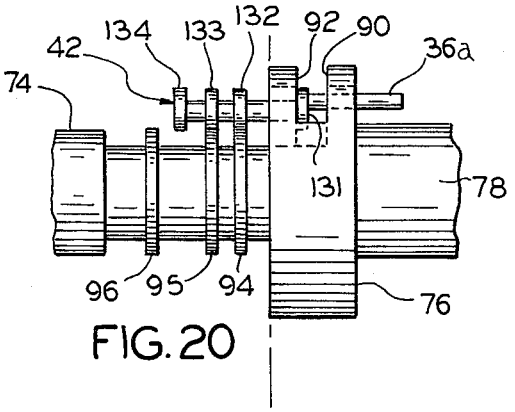

FIGS. 12 and 19 illustrate additional positions of the pick-resistant follower element 42 in which when picking torque is applied to the operating part 26 to rotationally displace the annular ledges 94–96 relative to the ribs 132–134, the ribs are situated for overlappingly engaging the ledges, to prevent longitudinal movement of the follower element 42. In these instances, both forward and rearward movement of the follower element 42 is prevented, while the follower element bridges the interfacial plane 146. FIGS. 18 and 20 illustrate additional positions of the pick-resistant follower element 42 in which the ribs 132–134 are seated in the cutouts 94*a*–96*a* of the annular ledges 94–96, whereby the ribs are abuttingly engageable with the ledges, to prevent displacement of the operating part relative to the sleeve part 28 sufficiently for picking purposes.

In the longitudinal positions of the pick-resistant follower element 42 which are illustrated in FIGS. 12 and 20, and in other positions therebetween, the first rib 131 is situated in the groove 90 in the operating part head 76. If the operator of the picking tool is successful in rotationally displacing the operating part 26 relative to the sleeve part 28, the first rib 131 will overlap the arcuate ledge 92 adjacent to the counterbore 88 in the head, for engagement therebetween to prevent rearward movement of the follower element 42. At the same time, the follower element 42 bridges the interfacial plane 146, to prevent rotation of the operating part 26 for unlocking purposes.

A feature of the preferred illustrative embodiment of the invention contributing to its success is the eccentric mounting of the pick-resistant follower element 42 relative to its driver element 36*a*. When pick finger pressure is exerted on the driver element 36*a*, the follower element 42 will have a tendency to cant, owing to the tolerances. The canting increases the likelihood that one or more of the ribs 131–134 will overlappingly engage one or more of the ledges 92 and 94–96, to prevent longitudinal movement of the follower element 42.

Another preferred feature of the invention is the use of driver elements 36 and an operating part head 76 which have a uniform appearance from outside of the lock mechanism 20, and appear the same as prior lock mechanisms, so that the presence and location of the pick-resistant tumbler are not detectable. In this connection, the location of the pick-resistant tumbler 32 may be varied from lock to lock.

The length of the follower element 42 may be varied from the illustrative embodiment, and the number and spacing of the ribs thereon may be varied. Likewise, the number and spacing of the annular ledges may be varied. Additional longitudinal positions of the follower element 42 relative to the operating part 26 may be provided, in which forward and/or rearward longitudinal movement of the follower element is prevented, or in which the ribs abuttingly engage the ledges to prevent displacement of the operating part 26. In particular, it may be advantageous to provide additional such positions wherein the follower element is situated rearwardly of the interfacial plane 146, with the driver element 36*a* bridging the interfacial plane.

While it is preferred to employ a plurality of spaced apart ledges on the operating part 26 and a plurality of spaced apart ribs on the pick-resistant follower element 42, whereby the ribs are adapted for overlappingly interengaging at least one rib and a ledge in each of a plurality of different longitudinal positions of the follower element relative to the operating part, it will be apparent that as little as one ledge and one rib may be employed to resist picking, in accordance with the invention. Thus, for example, a single ledge may be provided on the operating part shaft 74, adjacent to and intermediate the ends of the counterbore 128 in the sleeve part 28, while a single rib is provided on a follower element carried in the counterbore 128, for interengagement within the sleeve part 28 either to prevent forward movement of the follower element or to prevent rearward movement thereof.

The illustrative preferred pick-resistant tumbler 32 embodies a circular driver element 36*a* and a circular follower element 42, but these elements, as well as the elements of the conventional tumblers 30, may be constructed in other cross sectional shapes, such as polygonal. The manner in which the tumblers are mounted may be varied. For example, the bores in which the pick-resistant tumbler is mounted and/or the bores in which the conventional tumblers are mounted may be open to the sides of the operating and stationary parts 26 and 28. A plurality of pick-resistant tumblers may be employed, if desired.

Although the invention has been illustrated with reference to a two-part barrel assembly of the operating part 26 and the sleeve part 28, it will be apparent that the invention is similarly applicable to barrel assemblies having more than two parts provided with tumbler bores arranged for alignment. Thus, for example, the invention may be applied to lock mechanisms having three-part barrel assemblies, such as disclosed in the above-identified U.S. Pat. Nos. 3,541,819 and 3,916,657.

While a preferred embodiment of the invention has been illustrated and described, and reference has been made to certain changes and modifications which may be made in the embodiment, it will be apparent to those skilled in the art that further changes and modifications may be made therein within the spirit and scope of the invention. It is intended that all such changes and modifications be included within the scope of the appended claims.

Having thus described the invention, what I claim as new and desire to secure by Letters Patent is:

1. In an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary part adjoining the operating part at a transverse interfacial plane, means forming longitudinal bores in said operating and stationary parts respectively, said bores in respective parts being movable into and out of alignment upon rotation of said operating part, tumblers each having a forwardly disposed driver element carried in one of said operating part bores and a separate rearwardly disposed follower element carried in one of said stationary part bores and the elements adjoining each other when in a pair of aligned bores, said tumblers each being reciprocally movable in the axial direction in a pair of aligned bores between positions wherein the joint between said elements thereof is disposed on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and stationary parts against relative rotation, said driver elements having front ends engageable with a key which when moved rearwardly moves said tumblers in aligned bores into positions wherein said joints coincide with said interfacial plane, the improvement which comprises:

ledge means on said operating part and adjacent to and intermediate the ends of a bore in said stationary part, and rib means on a follower element carried in the latter bore and adapted to overlappingly engage said ledge means when picking torque is applied to said operating part and while the joint of the tumbler which includes said follower element is displaced from said interfacial plane, for preventing longitudinal movement of the last-named follower element in the direction of said interfacial plane.

2. A lock mechanism as defined in claim 1 and wherein said rib means is adapted to overlappingly engage said ledge means upon said application of torque while the driver element of the last-named tumbler bridges said interfacial plane, for preventing forward movement of said last-named follower element.

3. A lock mechanism as defined in claim 1 and wherein said last-named follower element is mounted eccentrically with respect to the driver element forming a tumbler therewith, whereby said last-named follower element has a tendency to cant upon application of force thereto by the latter driver element.

4. A lock mechanism as defined in claim 1 and wherein said ledge means comprises a plurality of ledges spaced apart along said operating part, and said rib means comprises a plurality of ribs spaced apart along said last-named follower element, whereby at least one rib is adapted to overlappingly engage a ledge in each of a plurality of different longitudinal positions of said last-named follower element relative to said operating part upon said application of torque and while the tumbler joint is displaced from said interfacial plane, for preventing longitudinal movement of said last-named follower element in the direction of said interfacial plane.

5. A lock mechanism as defined in claim 4 and wherein said ledges include a ledge adjacent to and intermediate the ends of a bore in said operating part, and said ribs include a rib adjacent to the head of said last-named follower element.

6. A lock mechanism as defined in claim 5 and wherein said ledges include a plurality of ledges adjacent to and intermediate the ends of said bore in said stationary part, and said ribs include a plurality of ribs disposed rearwardly from the head of said last-named follower element.

7. In an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary sleeve part, said operating part including a cylindrical head having front and rear faces and an axial lock shaft of reduced diameter extending rearwardly from said rear face, said sleeve part journaling said shaft and having a front face adjoining the rear face of said head at a transverse interfacial plane, means forming longitudinal bores in said operating part head and said sleeve part, respectively, and disposed radially outwardly of said shaft therearound, said bores in respective parts being movable into and out of alignment upon rotation of said operating part, tumblers each having a forwardly disposed driver element carried in one of said head bores and a separate rearwardly disposed follower element carried in one of said sleeve part bores and the elements adjoining each other when in a pair of aligned bores, said tumblers each being reciprocally movable in the axial direction in a pair of aligned bores between positions wherein the joint between said elements thereof is disposed on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and sleeve parts against relative rotation, said driver elements having front ends engageable with a key which when moved rearwardly moves said tumblers in aligned bores into positions wherein said joints coincide with said interfacial plane, the improvement which comprises:

annular ledge means on said shaft and adjacent to and intermediate the ends of a bore in said sleeve part, and rib means on a follower element carried in the latter bore and adapted to overlappingly engage said ledge means when picking torque is applied to said operating part and while the joint of the tumbler which includes said follower element is displaced from said interfacial plane, for preventing longitudinal movement of the last-named follower element in the direction of said interfacial plane.

8. A lock mechanism as defined in claim 7 and including additional ledge means on said operating part head intermediate said faces thereof and adjacent to a bore therein receiving said last-named follower element, said rib means being adapted to overlappingly engage said additional ledge means upon said application of torque and while said last-named follower element bridges said interfacial plane, for preventing rearward movement of said last-named follower element.

9. A lock mechanism as defined in claim 7 and wherein said ledge means comprises a plurality of ledges spaced apart along said shaft, and said rib means comprises a plurality of ribs spaced apart along said last-named follower element, whereby at least one rib is adapted to overlappingly engage a ledge in each of a plurality of different longitudinal positions of said last-named follower element relative to said shaft upon said application of torque and while the tumbler joint is displaced from said interfacial plane, for preventing longitudinal movement of said last-named follower element in the direction of said interfacial plane.

10. A lock mechanism as defined in claim 9 and including an additional ledge on said operating part head intermediate said faces thereof and adjacent to a bore therein receiving said last-named follower element, one of said ribs on said last-named follower element adjacent to its head being adapted to overlappingly engage said additional ledge upon said application of torque and while the follower element bridges said interfacial plane, for preventing rearward movement of said last-named follower element.

11. In an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary tubular sleeve part, said operating part including a cylindrical head having front and rear faces and an axial lock shaft of reduced diameter extending rearwardly from said rear face, said sleeve part journaling said shaft and having a front face adjoining the rear face of said head at a transverse interfacial plane, means forming longitudinal cylindrical bores in said operating part head and said sleeve part, respectively, and disposed radially outwardly of said shaft therearound, said bores in respective parts being movable into and out of alignment upon rotation of said operating part, one of said sleeve part bores intersecting the inner wall surface on the sleeve part to place the bore and the interior of the sleeve part in open communication, tumblers each having elements of circular cross section including a forwardly disposed driver element carried in one of said head bores and a separate rearwardly disposed follower element carried in one of said sleeve part bores and the elements adjoining each other when in a pair of aligned bores, said tumblers each being reciprocally movable in the axial direction in a pair of aligned bores between positions wherein the joint between said elements thereof is disposed on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and sleeve parts against relative rotation, said driver elements having front ends engageable with a key which when moved rearwardly moves said tumblers in aligned bores into positions wherein said joints coincide with said interfacial plane, the improvement which comprises:

a plurality of annular ledges on said shaft and spaced apart therealong, said ledges being journaled in said sleeve part, a plurality of annular ribs on one of said follower elements and spaced apart therealong, said one follower element being carried in said one sleeve part bore and said ribs projecting laterally outwardly into the interior of the sleeve part, and means providing a movement path along said shaft in which said one follower element may be moved longitudinally while said ribs pass said ledges without interference, said ribs being adapted for overlappingly interengaging at least one rib and a ledge in each of a plurality of different longitudinal positions of said one follower element relative to said shaft when picking torque is applied to said operating part and while the joint of the tumbler which includes said one follower element is displaced from said interfacial plane, for preventing longitudinal movement of said one follower element in the direction of said interfacial plane, and said ribs interfitting with said ledges to avoid interference with rotation when said tumbler joints coincide with said interfacial plane.

12. A lock mechanism as defined in claim 11 and wherein said ribs further are adapted for abuttingly interengaging at least one rib and a ledge in an alternate longitudinal position of said one follower element when picking torque is applied to said operating part, for limiting rotational displacement of the operating part relative to the sleeve part.

13. A lock mechanism as defined in claim 11 and including an additional ledge on said operating part head intermediate said faces thereof and adjacent to a bore therein receiving said one follower element, and an additional annular rib on said one follower element adjacent to its head and adapted to overlappingly engage said additional ledge upon said application of torque and while the follower element bridges said interfacial plane, for preventing rearward movement of said one follower element.

14. A lock mechanism as defined in claim 13 and wherein said one follower element is mounted eccentrically with respect to the driver element forming a tumbler therewith, whereby said one follower element has a tendency to cant upon application of force thereto by the latter driver element.

15. A lock mechanism as defined in claim 13 and wherein said ribs further are adapted for abuttingly interengaging at least one rib and a ledge in an alternate longitudinal position of said one follower element when picking torque is applied to said operating part, for limiting rotational displacement of the operating part relative to the sleeve part.

16. A lock mechanism as defined in claim 13 and including means forming a transverse groove in said head intermediate said faces thereof and intersecting said bore receiving said one follower element, said groove means providing said additional ledge.

17. A lock mechanism as defined in claim 1 and wherein said rib means is adapted to overlappingly engage said ledge means upon said application of torque while said last-named follower element bridges said interfacial plane, for preventing rearward movement of said last-named follower element.

18. A lock mechanism as defined in claim 1 and including additional ledge means on said operating part and adjacent to and intermediate the ends of a bore therein receiving said last-named follower element, said rib means being adapted to overlappingly engage said additional ledge means upon said application of torque and while said last-named follower element bridges said interfacial plane, for preventing rearward movement of said last-named follower element.

* * * * *